United States Patent [19]

van Wegen

[11] 4,077,314

[45] Mar. 7, 1978

[54] WIRE OR BAND STRAPPING MACHINE

[75] Inventor: Wilhelmus F. S. M. van Wegen, Maartensdijk, Netherlands

[73] Assignee: Metaverpa N.V., Netherlands

[21] Appl. No.: 734,380

[22] Filed: Oct. 21, 1976

[51] Int. Cl.[2] ..... B65B 13/10

[52] U.S. Cl. ..... 100/26

[58] Field of Search ..... 100/26

[56] References Cited

U.S. PATENT DOCUMENTS

| | | | |
|---|---|---|---|
| 3,046,871 | 7/1962 | Chessman | 100/26 |
| 3,179,038 | 4/1965 | MacKenzie | 100/26 |
| 3,220,337 | 11/1965 | Goland et al. | 100/26 X |
| 3,667,378 | 6/1972 | Van de Bilt | 100/26 |

*Primary Examiner*—Daniel Blum

*Attorney, Agent, or Firm*—Bucknam and Archer

[57] ABSTRACT

A wire or band strapping machine comprises a driven roll pair for feeding a wire or band towards a guide loop about an object to be strapped as well as a driven roll pair for reversing the direction of movement of the wire or band to draw the same out of the guide and about the object, said pairs of driven rolls being placed at a distance above each other with the wire or band approaching the loop along a vertical U-shaped path with the feeding and reversing roll pairs operating on the upper and lower horizontal legs of that path. The motor drives the feeding roll pair by an endless member while the reversing roll pair is driven by the endless member between the two roll pairs.

1 Claim, 2 Drawing Figures

WIRE OR BAND STRAPPING MACHINE

Figure 1:
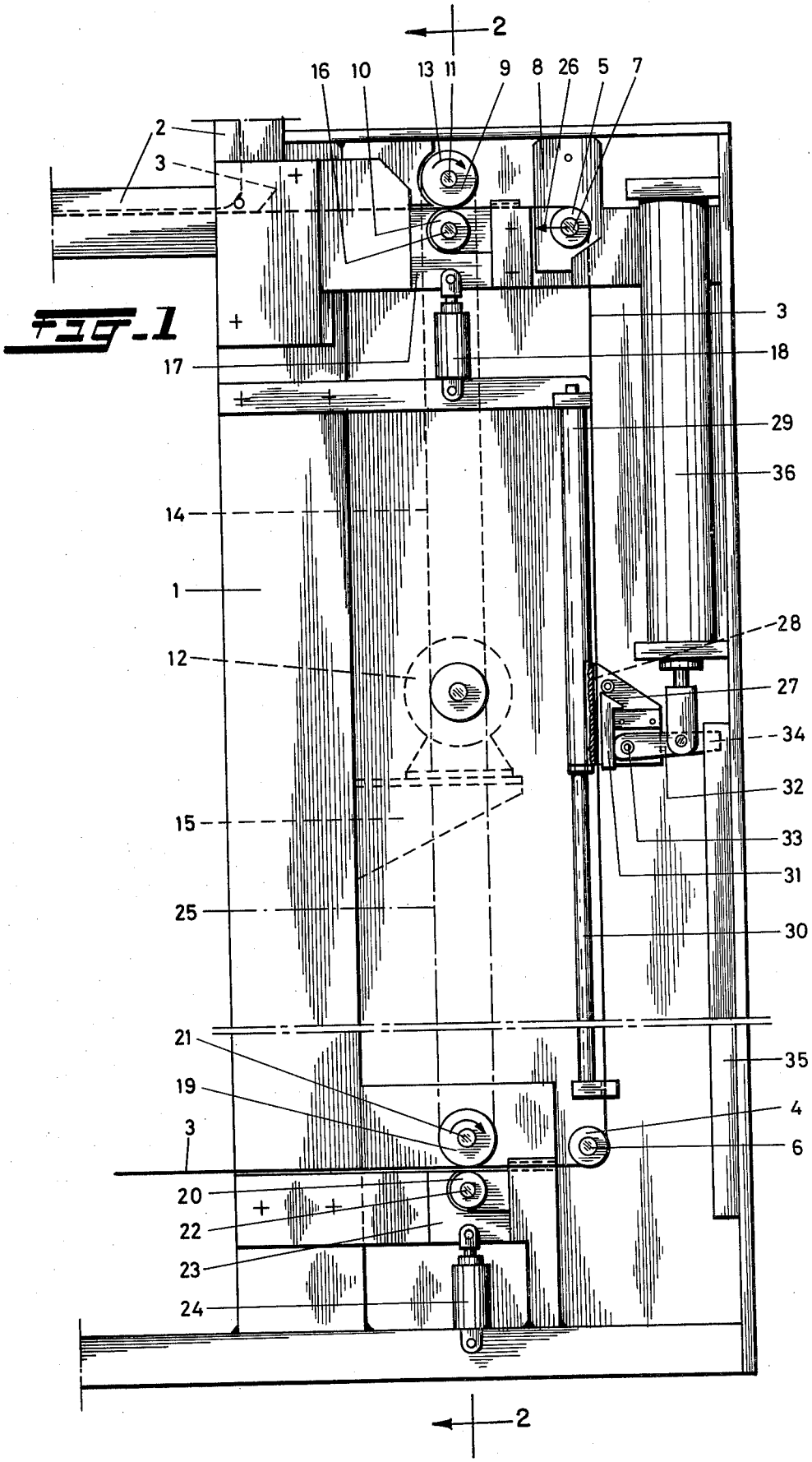

The present invention relates to a wire or band strapping machine, comprising means for guiding a wire or band about a looped path, means for feeding the wire or band comprising a driven roller, a freely rotatable roller and means for urging said freely rotatable roller towards said driven roller, means for reversing the direction of movement of the wire or band to withdraw the wire or band to tighten the wire or band about an object to be strapped, said means as well comprising a driven roller at a freely rotatable roller and means for urging said freely rotatable roller towards said driven roller, said last mentioned roller rotating relative to the band in a direction opposite to the direction of the first mentioned feed roller, said first mentioned roller being disposed a distance above said second driven roller, an endless member interconnecting both said driven rollers and further rollers deflecting the wire or band into the shape of a horizontal U, whose horizontal legs pass through said driving means, and a motor driving the first mentioned roller through an endless member.

A machine of this kind is disclosed for example in U.S. Pat. No. 3,667,378. In the apparatus of the above patent the infeed and reversal of the band or wire takes place by means of rollers driven in opposite directions against which the band or wire can be pressed by means of freely rotatable rollers movable from and toward the driven rollers. Said driven rollers are interconnected by an endless belt and the motor directly drives the roller for the reversal for the band or wire.

When in this known machine the infeed rollers feed a band or wire into the guiding part the motor will be stopped as soon as the free end of the band or wire reaches the end of the looped path and is stopped due to which a switch is operated. Use can be made of the system described in U.S. Pat. No. 3,589,275, issued June 29, 1971. When the machine is started to apply a strap around a package or the like the motor must be stopped as soon as the band or wire is withdrawn from the frame and applied around the package. This is done by one of the rollers deflecting the wire or band into the shape of a horizontal U and when this roller is displaced the motor is stopped and the final tensioning mechanism is put into operation.

The known machine has the disadvantage that in particular the reversal rollers burn the band or wire when the same is made from synthetic material and this is due to the inertia of the motor. This reduces the speed of the machine.

Purpose of the present invention is to find a solution for this problem and this purpose is achieved in that the motor only drives the first mentioned roller directly through a separate endless member.

The reversal rollers now are driven indirectly through the intermediary of two endless belts, one between the motor and the in-feed rollers and the other between in-feed rollers and reversal rollers. The unexpected result is that the number of straps the machine can apply per minute is almost doubled (from 30 straps per minute to 50 straps per minute).

Preferably the motor is placed halfway inbetween the two sets of rollers.

The invention now will be further described with reference to the accompanying drawing, showing the feed and withdrawal mechanism in the same way as disclosed in FIG. 2 of U.S. Pat. No. 3,667,378. This figure only discloses a part of the strapping machine.

FIG. 1 of the drawing shows a frame 1 in elevation provided on one side of the machine and supporting a band guide frame 2 of which only parts are shown.

Figure 2:
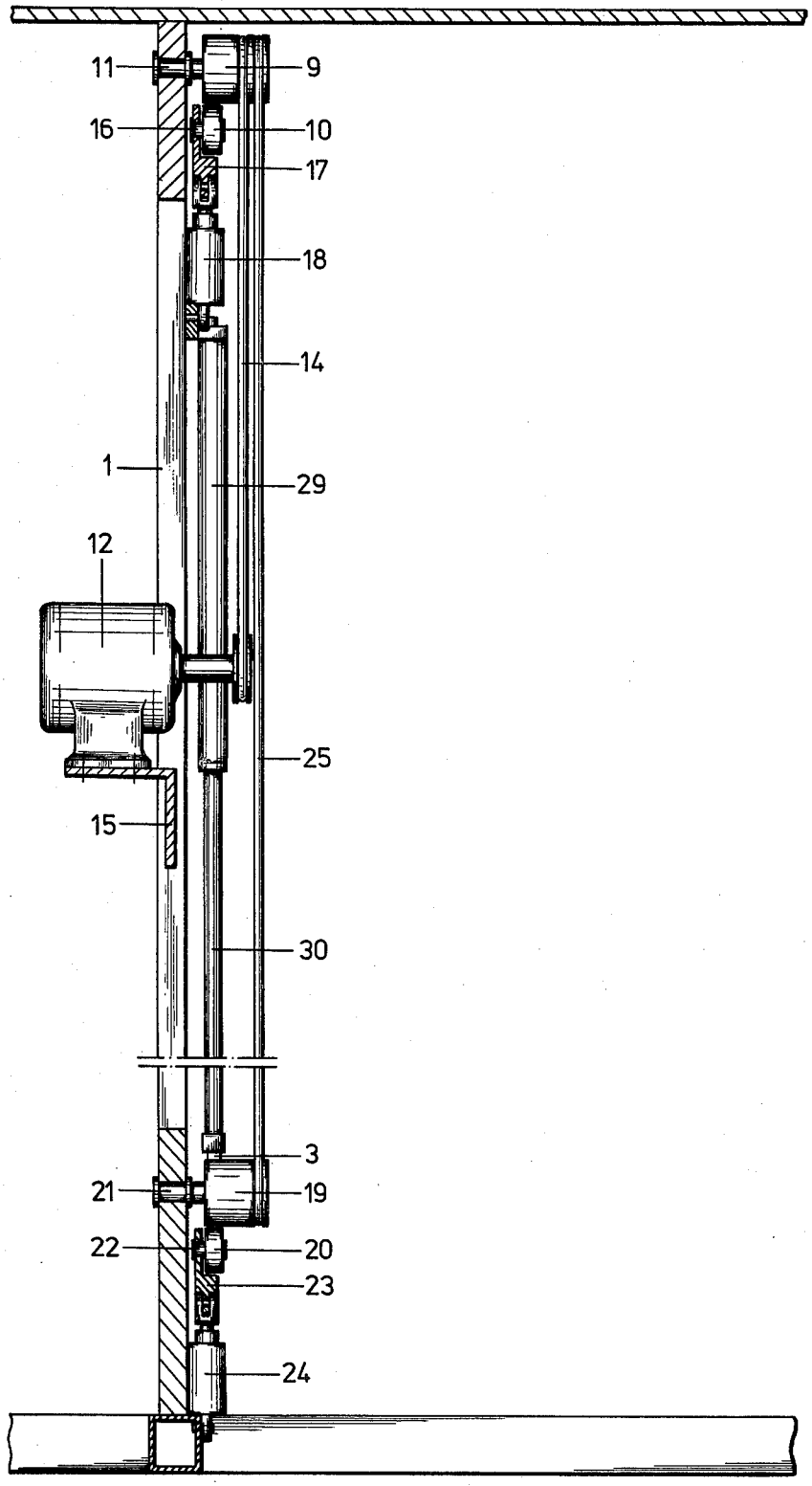

FIG. 2 is a cross-sectional view through line 2—2 of FIG. 1.

In the drawing the band 3 coming from a storage roll (not shown) is fed into the band guide frame 2 via two guide rollers 4 and 5. The roller 4 rotates about a stationary shaft 6 and roller 5 rotates about a shaft 7 secured on a swivelling arm 8. A spring holds the arm in its normal position.

The feed of the band 3 takes place by means of a pair of rollers 9 and 10, the roller 9 rotating about a stationary shaft 11 being driven by an electro-motor 12 in the direction of arrow 13 by means of a belt 14, said motor being rigidly mounted in the frame 1 upon a support 15. The roller 10 rotates about a shaft 16 secured on a sliding piece 17 which can be moved up and down by a pneumatic cylinder 18, secured in the frame 1. In the retracted position of the piston rod of the cylinder 18 the band 3 may pass freely between the rollers 9 and 10. When the sliding piece 17 is moved upward by the cylinder 18 and band 3 is gripped between the pair of rollers 9 and 10 and when the roller 9 is driven by the electromotor 12 the band 3 will thus be fed into the guide frame 2.

The withdrawal mechanism is formed by a pair of rollers 19 and 20, the roller 19 rotating about a stationary shaft 21 and the roller 20 being able to rotate about the shaft 22, secured on a sliding piece 23, which is moved up and down by means of a cylinder 24. The roller 19 is connected with the roller 9 by means of the endless belt 25. Accordingly rollers 19 and 20 are driven by motor 12 by the belts 14 and 25.

When the band 3 is withdrawn by means of rollers 19 and 20 the roller 5 will be moved in the direction of the arrow 26 when the band is applied around the package. Motor 12 then will be stopped. Due to the flexible connection between motor 12 and roller 19 obtained by means of the two belts 14 and 25, which flexibility not only is obtained by the resiliency of the belt but also by the possibility of slippage, the inertia of motor 12 has less influence upon roller 19, so that roller 19 can be stopped much more quickly so that the risk of burning of the synthetic band 3 is reduced and accordingly the speed of the machine can be increased.

The drawing further discloses a tension device located between the in-feed rollers 9, 10 and withdrawal rollers 19, 20, said device comprising a housing 27 with a slot 28, through which the band 3 passes. The housing 27 is connected to a tube 29 which slides over a guide means 30. A clamping shoe 31 at a lever 32 are located in the housing 27. Lever 32 pivots about a pin 33. The other outer end 34 of the lever 32 is guided in a U-shaped guide means 35, secured to the frame 1.

This tension device is connected with a cylinder 36. When the piston rod of cylinder 36 is moved downwardly first lever 32 is swivelled downwards and will press the clamping shoe 31 against the band 3, as a result of which said band is gripped in the passage 28 of the housing 27. When moving the piston rod of the cylinder 36 further downwards the gripped band will then be carried by the housing 27 and will be tensioned further.

What is claimed is:

1. Wire or band strapping machine, comprising means for guiding a wire or band about a looped path, means for feeding the wire or band comprising a driven roller, a freely rotatable roller and means for urging said freely rotatable roller towards said driven roller, means for reversing the direction of movement of the wire or band to withdraw the wire or band to tighten the wire or band about an object to be strapped, said means as well comprising a driven roller at a freely rotatable roller and means for urging said freely rotatable roller towards said driven roller, said last mentioned roller rotating relative to the band in a direction opposite to the direction of the first mentioned feed roller, said first mentioned roller being disposed a distance above said second driven roller, an endless member interconnecting both said driven rollers, and further rollers deflecting the wire or band into the shape of a vertical U, whose horizontal legs pass through said driving means, and a motor driving the first mentioned roller through a second endless member, wherein the motor only drives the first mentioned roller directly through said second separate endless member and the motor is placed halfway between the two driven rollers.

* * * * *